United States Patent [19]

Miram et al.

[11] Patent Number: 5,015,908

[45] Date of Patent: May 14, 1991

[54] FAST WARM-UP CATHODE FOR HIGH POWER VACUUM TUBES

[75] Inventors: George V. Miram, Atherton; Yosuke M. Mizuhara, Palo Alto, both of Calif.

[73] Assignee: Varian Associates, Inc., Palo Alto, Calif.

[21] Appl. No.: 299,296

[22] Filed: Jan. 23, 1989

[51] Int. Cl.[5] ..... H01J 1/15

[52] U.S. Cl. ..... 313/37; 313/270; 313/346 R; 445/35; 445/46; 445/51

[58] Field of Search ..... 313/37, 39, 40, 15, 313/270, 346 R; 445/51, 35, 46, 50

[56] References Cited

U.S. PATENT DOCUMENTS

| | | | |
|---|---|---|---|
| 2,996,643 | 8/1961 | Johnstone et al. | 315/105 |
| 3,299,317 | 1/1967 | Kendall, Jr. | 315/106 |
| 3,671,792 | 6/1972 | Waltermire | 313/337 |
| 4,096,406 | 6/1978 | Miram | 313/348 |
| 4,220,889 | 9/1980 | Marhic et al. | 313/270 X |
| 4,263,528 | 4/1981 | Miram | 313/293 |
| 4,675,573 | 6/1987 | Miram et al. | 315/94 |

FOREIGN PATENT DOCUMENTS

| | | |
|---|---|---|
| 0130395 | 1/1985 | European Pat. Off. . |
| WO88/04468 | 6/1988 | PCT Int'l Appl. . |

*Primary Examiner*—Donald J. Yusko
*Assistant Examiner*—Michael Horabik
*Attorney, Agent, or Firm*—Stanley Z. Cole; Sheri M. Novack

[57] ABSTRACT

In order to bring a high power vacuum tube to full power in a few seconds, it is necessary to heat the cathode quickly to 1100° C. In large tubes, prior art structures cannot be simply enlarged. A novel cathode structure in which the heater element is anisotropic pyrolytic graphite coated with anisotropic pyrolytic boron nitride for insulation and then sintered to the cathode avoids these problems.

9 Claims, 5 Drawing Sheets

STEP a
100
100
STEP b
102
100
STEP c
104
102
STEP d
106
STEP e
STEP f
108
110
STEP g
112

200
STEPh
202
STEPi
204
STEPj
206
STEPk
208
STEPℓ
210

100
STEP m
100
STEP n
102
STEP o
104
STEP p
106
STEP q
108
STEP r
110
112

304
STEP s
306
302
304
STEP t
302
306
308
310
STEP u
312
314

FAST WARM-UP CATHODE FOR HIGH POWER VACUUM TUBES

FIELD OF THE INVENTION

This invention pertains to a fast warm-up heater for use in a high power vacuum tube and methods of forming same.

BACKGROUND OF THE INVENTION

In vacuum tubes for high power transmitters, it is often desirable to be able to switch the tube on to full power rapidly. Tubes, however, employ electron emitting cathodes which must be heated before they emit. The problem of switching the tube to full power rapidly then hinges on the ability to heat the cathode rapidly.

State-of-the-art fast warm-up cathodes are formed by sintering a heater to a low-mass cathode. The heater is made with cataphoretically coated tungsten insulated with an $Al_2O_3$ ceramic material. The sintering is usually done at 1300° C. using a mixture of 95% tungsten with 5% nickel. For small tubes, this approach is workable since the cathodes are small, usually 0.25 inches diameter or less. Sometimes a mix of molybdenum and ruthenium is used instead of W-Ni. The sintering temperature is then approximately 1600° C.

For larger cathodes, 0.5 inches diameter or higher, this approach becomes less workable. The problems become unacceptable for cathodes of greater than 1 inch diameter.

The problems can be illustrated by considering a requirement for a 1 megawatt klystrode tube with a 10 second warm-up time. The cathode would have to be about 2.5 inches diameter. The heater would have to heat the cathode inself, the heater wire, the insulating coating, the sintering material and the cathode support. To heat such a large cathode to operating temperature would require 15,000 joules. This amount of energy requires high currents and high voltages. The voltage across the $Al_2O_3$ would exceed the breakdown voltage of the material. In addition, currents of the order of 100 amperes have to be delivered to the active heater area. The connections then would have to be substantial conductors which would carry away heat and increase the current requirement further to compensate for the heat loss.

An additional problem in the prior art heaters is the great differences between the coefficients of expansion of the tungsten and the $Al_2O_3$. The different rates of expansion cause stress during heating which results in fatigue and failure.

To reduce the requirements for energy in a fast warm-up cathode, as illustrated in the example above, a bombarder heater is often used. An example is shown in U.S. Pat. No. 4,675,573. The bombarder is a heated emitting structure placed behind the cathode. There is a significant electric field between the bombarder and the cathode. Electrons emitted from the bombarder are accelerated into the back of the cathode to heat the cathode.

A quick-heating cathode for an electron tube is described in U.S. Pat. No. 3,299,317 to J. W. Kendall, Jr. In this cathode a wire braid is connected in series with the cathode cylinder. The braid has a high electrical resistance when hot and a low electrical resistance when cold, thus permitting large amounts of current to initially surge through the braid to heat the cathode directly at turn-on. After the initial high current surge, the braid becomes hot and its electrical resistance becomes high. When the braid is hot, less current passes through if for direct heating of the cathode; however, at this time the braid also heats the cathode indirectly due to its high electrical resistance.

A further fast-heating cathode for an electron tube is disclosed in U.S. Pat. No. 2,996,643 to F. C. Johnstone et al. In this cathode arrangement a first voltage is initially applied across a filament spaced from the back surface of the cathode, causing the filament to emit thermionic electrons. A second voltage applied between the filament and the cathode accelerates the emitted electrons to the back surface of the cathode. These electrons bombard the back surface of the cathode to produce rapid heating of the cathode. After the cathode reaches electron emission temperature, the voltage between the cathode and filament is removed, and thermal radiation from the filament maintains the cathode at its operating temperature.

U.S. Pat. No. 4,675,573 issued Jun. 23, 1987 to Miram et al, and assigned in common with the present patent, discloses a fast warm-up cathode arrangement in which the cathode is directly heated with a burst of current through the cathode and then heated from behind by a heater coil.

OBJECTIVES OF THE INVENTION

It is therefore a primary objective of the present invention to provide a heater cathode assembly which avoids the use of $Al_2O_3$ as an insulator, and uses a more modest current than tungsten wires.

It is a further object of the invention to devise a structure in which the coefficients of thermal expansion of the materials match in order to prolong the life of the heater.

SUMMARY OF THE INVENTION

The object of the invention and other objects, features and advantages to become apparent as the specification progresses are accomplished by the invention according to which, briefly stated, anisotropic pyrolitic graphite heater insulated with a layer of anisotropic pyrolitic boron nitride is used to heat the cathode. The heater is sintered to the back of the cathode body.

LIST OF ADVANTAGES OF THE INVENTION

An important advantage of the present invention is that the breackdown voltage of the heater insulation at elevated temperatures is approximately two orders of magnitude better than for $Al_2O_3$ ceramic.

Another advantage is that the surge current required in an order of magnitude less than for the design of the prior art.

Still another advantage of the invention is that the coefficients of expansion of the heater and the insulator are closely matched.

These and further obiectives, constructional and operational characteristics, and advantages of the invention will no doubt be more evident to those skilled in the art from the detailed description given hereinafter with reference to the figures of the accompanying drawings which illustrate a preferred embodiment by way of non-limiting example.

LEXICON

APBN—Anisotrophic Pyrolytic Boron Nitride
APG—Anisotrophic Pyrolytic Graphite

GLOSSARY

The following is a glossary of elements and structural members as reference and employed in the present invention.

10—cathode assembly
12—cathode
14—heater according to the invention
16—bombarder heater
18—heater central lead
20—grid
100—anisotropic pyrolytic boron nitride form
102—layer of anisotropic pyrolytic graphite
104—heater pattern
106—layer of anisotropic pyrolytic boron nitride
108—thin layer of anisotropic pyrolytic graphite covered with a thin layer of tungsten
110—cathode
112—sintering mix W-Ni
200—anisotropic pyrolytic graphite form
202—heater pattern
204—coat of anisotropic pyrolytic boron nitride
206—thin layer of anisotropic pyrolytic graphite covered with a thin layer of tungsten
208—cathode
210—sintering mix of W-Ni
302—anisotropic pyrolytic boron nitride substrate
304—anisotropic pyrolytic graphite front coating
306—anisotropic pyrolytic graphite back coating
308—heater pattern
310—tungsten cathode
312—tungsten-nickel sintering mix
314—molybdenum holder

DESCRIPTION OF THE PREFERRED EMBODIMENTS

Figure 1:
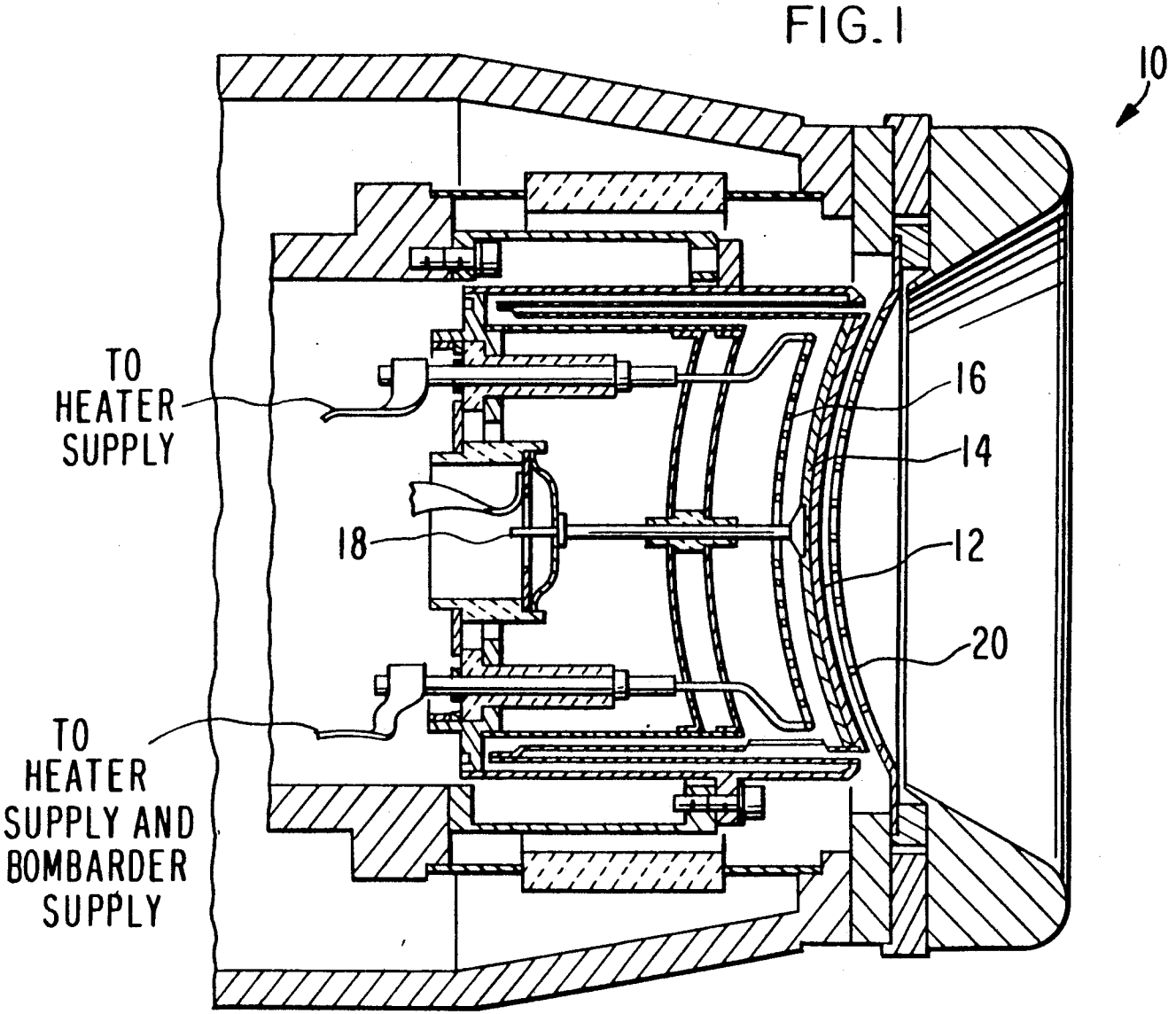
FIG. 1 shows a sectional view of the structure according to the invention mounted in one end of a vacuum tube with bombarder included.

Referring now to the drawings wherein reference numerals are used to designate parts throughout the various figures thereof, there is shown in FIG. 1 a sectional view of the structure according to the invention. A cathode assembly 10 has a cathode 12 preferably of tungsten to which is sintered on the backside of the heater 14 according to the invention. Behind the heater 14 there is shown an optional bombarder heater 16 for large diameter tubes. A lead 18 at the central axis of the tube leads to the center of the heater 14. The return path for the heater current is a common ground from the outer perimeter of the heater. In a klystrode, a grid 20 is placed in front of the cathode. Various vacuum seals and insulators used to seal the structure to the tube and electrically insulate the elements from each other are well known to those skilled in the art.

Figure 2:
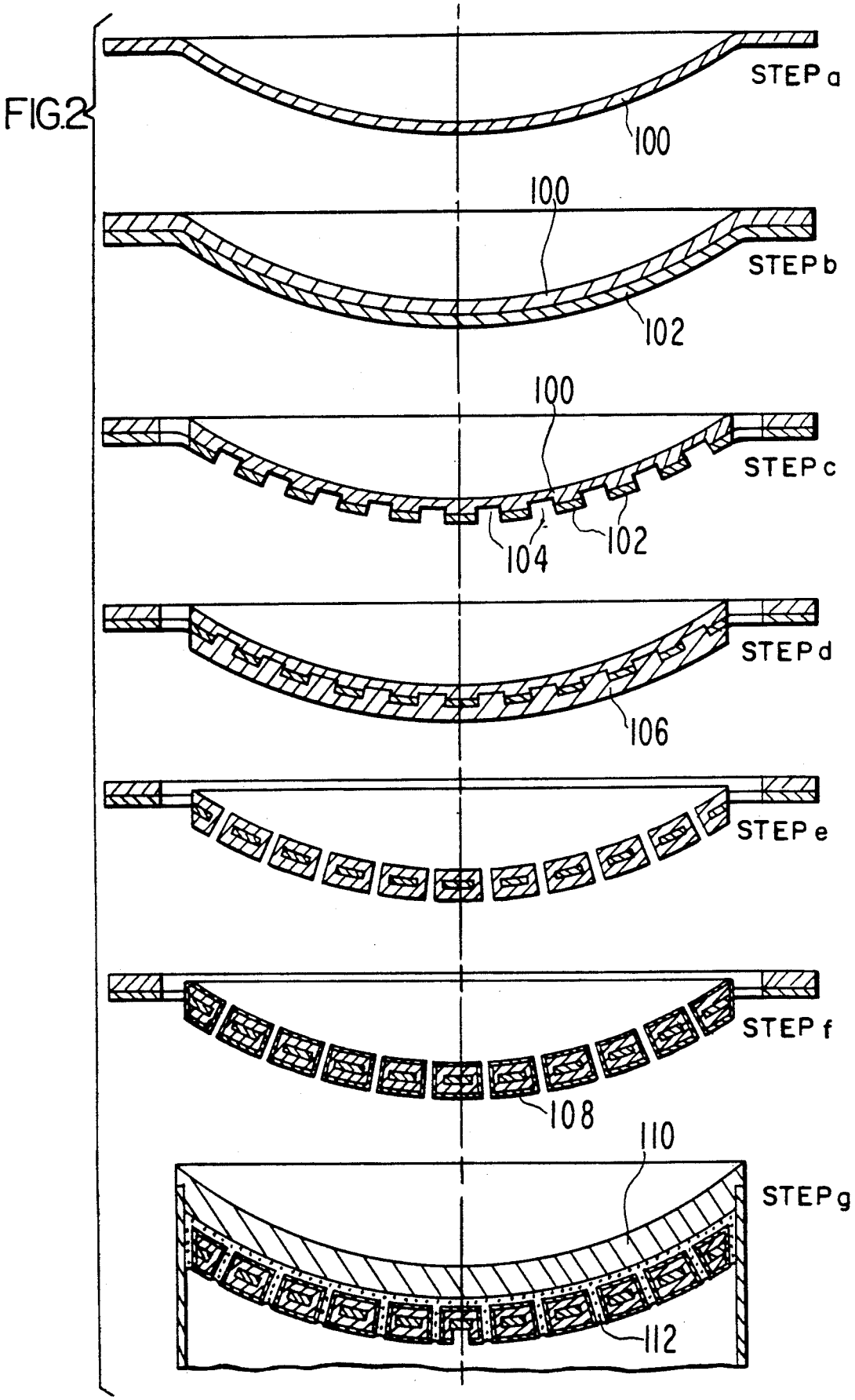
FIG. 2 shows a first method for forming the structure of the invention.

The device according to the invention can be formed in several allternate methods. The first method is shown in FIG. 2. At the top of the figure in step a, an anisotropic pyrolytic boron nitride form 100 is made to the desired shape to conform to the cathode. In step b, the form is coated with a layer of anisotropic pyrolytic graphite 102. In step c, the heater pattern 104 is milled through the anisotropic pyrolytic graphite into the anisotropic pyrolytic boron nitride form. In step d, the milled heater is coated with a layer of anisotropic pyrolytic boron nitride 106. In step e, a laser cutter is used to separate adjacent parts of the heater pattern 104. In step f, the device is first coated with a thin layer of anisotropic pyrolytic graphite and then with a thin layer of tungsten 108. In step g, the device is sintered to the cathode 110 using a W-Ni mix 112 at about 1300° C.

Figure 3:
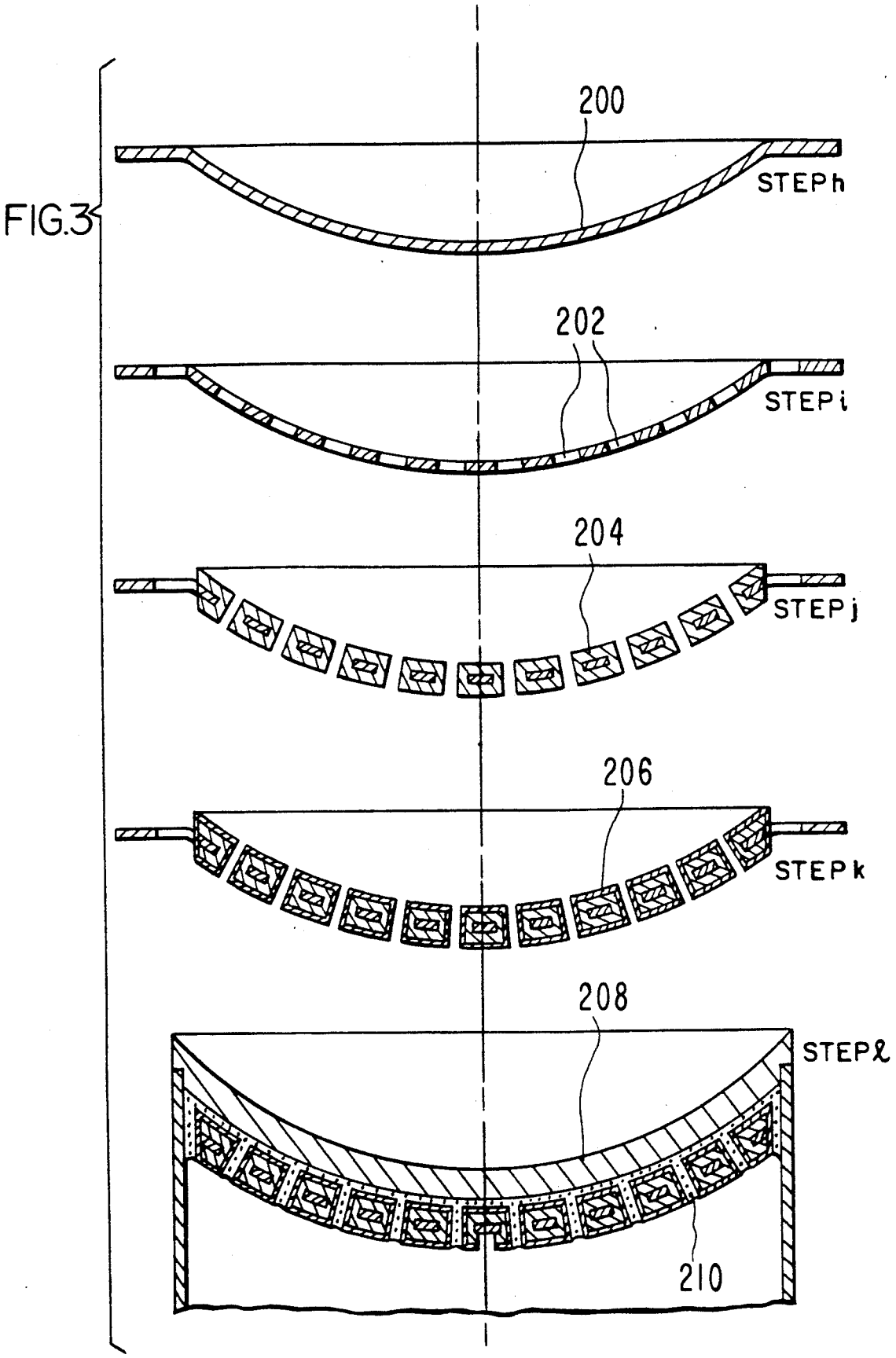
FIG. 3 shows a second method of forming the structure of the invention

An alternate method shown in FIG. 3, begins by forming a blank of anisotropic pyrolytic graphite 200 in a shape fitting to the shape of the cathode in step h. In step i, the heater pattern 202 is laser cut into the anisotropic pyrolytic graphite. Then in step j, the heater is coated with anisotropic pyrolytic boron nitride 204 all around. In step k, the heater is coated with a thin layer of anisotropic pyrolytic graphite and then with a thin layer of tungsten 206 all around. In step 1, the heater is instered to the cathode 208 at about 1300° C. using a W-Ni mix 210.

Figure 4:
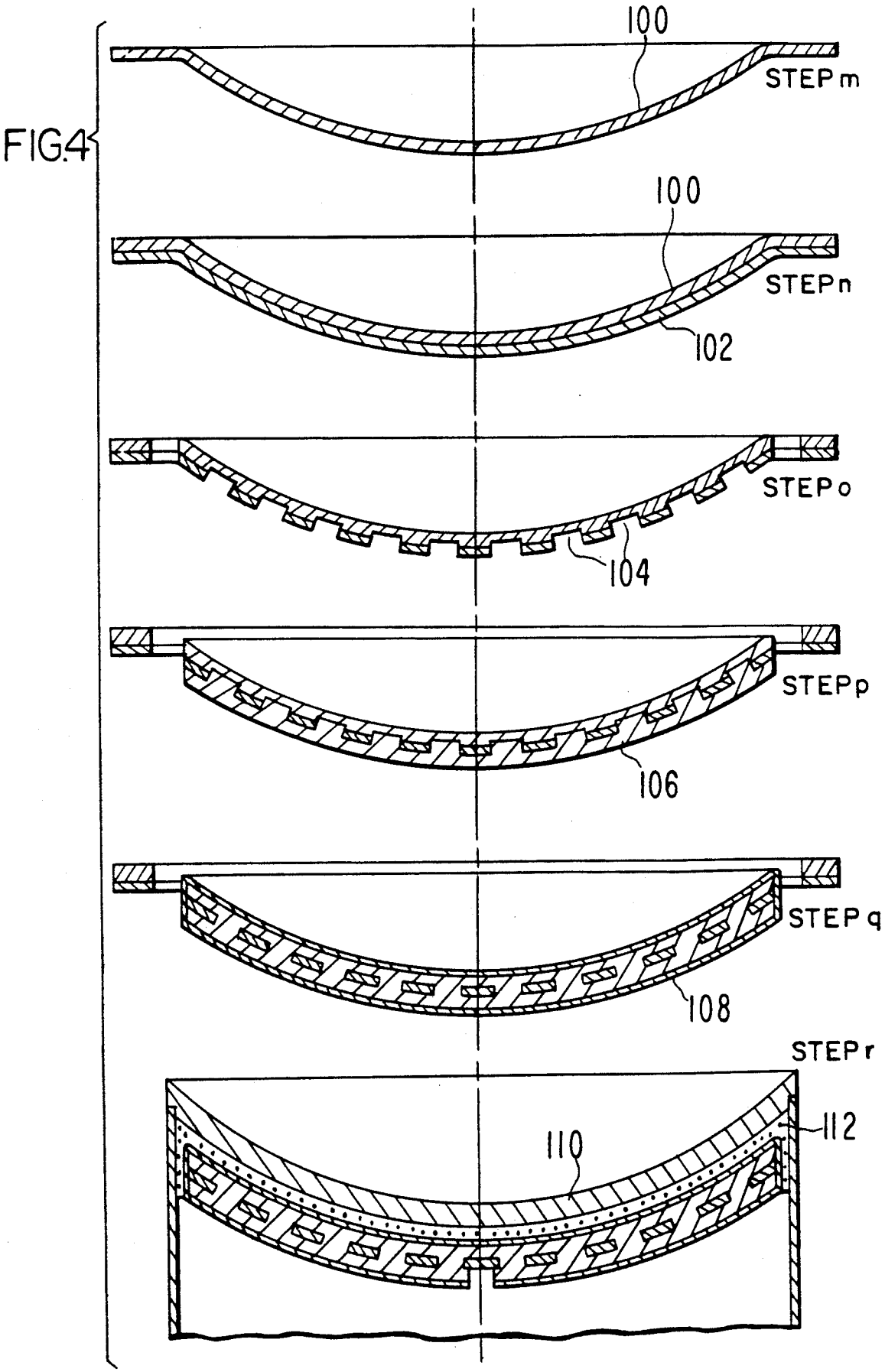
FIG. 4 shows a third method of forming the structure of the invention.

In the third method shown in FIG. 4, and anisotropic pyrolytic boron nitride form 100 is shaped to conform to the cathode in step m. The form is coated with anisotropic pyrolytic graphite 102 in step n. The heated pattern 104 is milled through the anisotropic pyrolytic graphite in step o. The pattern is coated with anisotropic pyrolytic boron nitride 106 in step p. The device is coated with anisotropic pyrolytic graphite and then with tungsten 108 in step q. The device is sintered to the cathode 110 in step r using a W-Ni mix 112 at about 1300° C.

Figure 5:
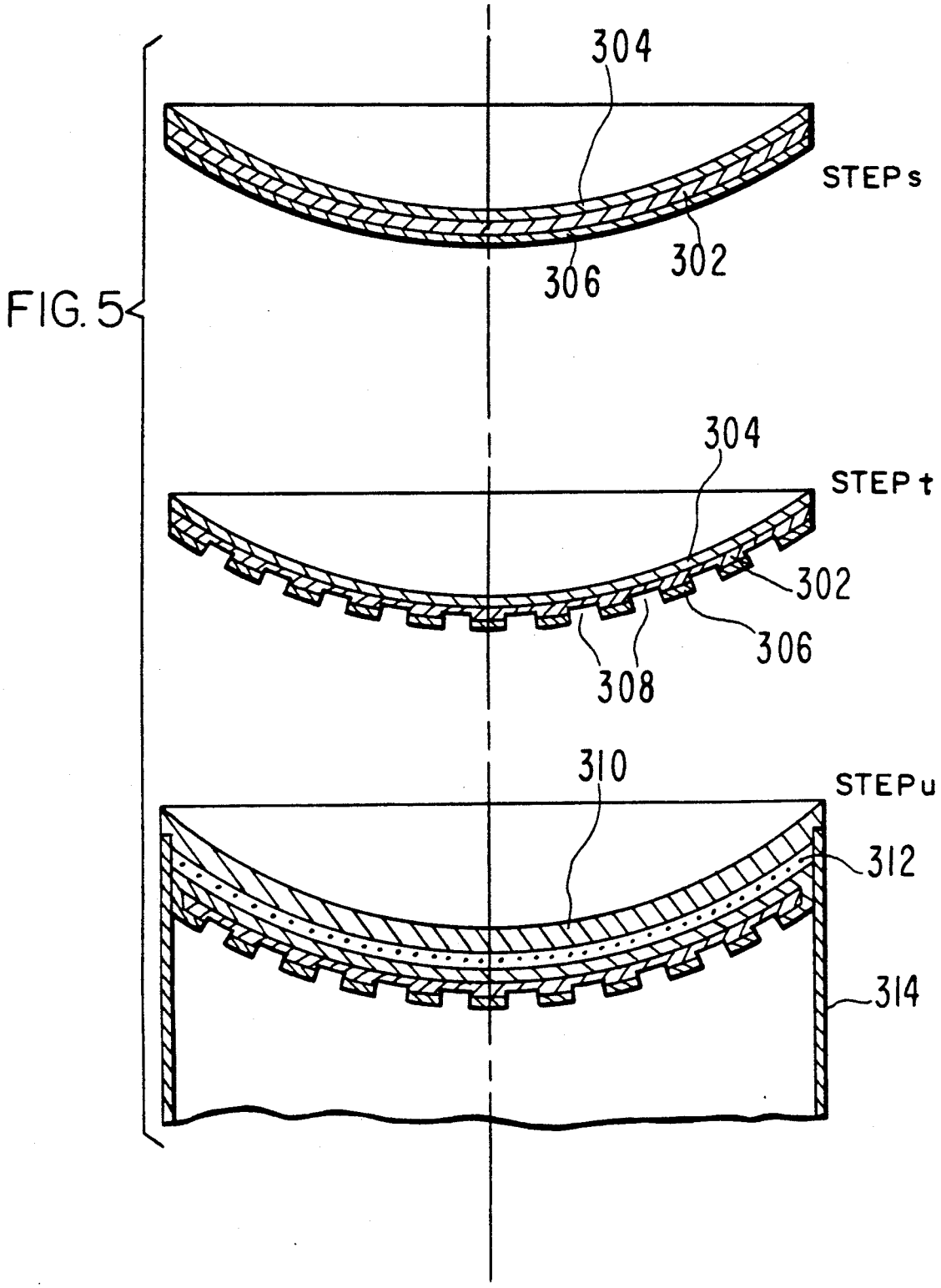
FIG. 5 shows a fourth method of forming the structure of the invention

In another alternate method shown in FIG. 5, a workpiece of anisotropic pyrolytic boron nitride 302 coated on both sides with anisotropic pyrolytic graphite 304, 306 is preformed in step s either concave to fit the back of the cathode or flat in the case of very small cathodes. In step t, the heater pattern 308 is formed in the backside coating of anisotropic pyrolytic graphite 306. In step u, the workpiece is then sintered to the back of the tungsten cathode 310 with a tungsten-nickel sintering mix 312. The entire structure is mounted on a molybdenum holder 314. One can purchase certain of these workpieces made to order and then from them into heater. Such adaptations are cost effective, but do increase the heating time by 10 to 20%

The voltage for breakdown of the anisotropic pyrolytic boron nitride at elevated temperature is approximately two orders of magnitude better than for $Al_2O_3$ ceramic. The voltage breakdown for the amisotropic pyrolytic boron nitride at 1200° C. is approximately 50 volts/mil as compared to 0.5 volts/mil for the $Al_2O_3$ ceramic at the same temperature. The coefficients of expansion for the heater conductor and insulator are much more closely matched for the heater of the invention than for tungsten with $Al_2O_3$, thereby reducing stress while heating. Also, the hot-to-cold resistance ratio of tungsten wire is approximately 5:1 as compared to 1:2 for anisotropic pyrolytic graphite. This makes it easier to maintain the temperature at a lower current with the invention after the fas warm-up.

In summary, the novel fast warm-up heater-cathode assembly according to the invention is uniquely suited for large diameter cathodes such as those used in klystrode tubes. In addition, the reduction in heater current and the excellent voltage breakdown characteristics of the anisotropic pyrolitic boron nitride insulation makes this design a good candidate for super fast applications where the bombarder approach was the only available solution in the prior art.

This invention is not limited to the preferred embodiment and alternatives heretofore described, to which variations and improvements may be made, without departing form the scope of protection of the present patent and true spirit of the invention, the characteristics of which are summarized in the following claims.

What is claimed is:

1. A heater-cathode structure for use in a high power vacuum tube, comprising:

a cathode;

a heater sintered to said cathode, said heater being formed of anisotropic pyrolitic graphite coated with a layer of anisotropic pyrolitic boron nitride.

2. The heater-cathode structure of claim 1 wherein the heater is sintered to the cathode with a sintering compound comprising tungsten and nickel.

3. A heater for a cathode in an electronic device comprising:

a substrate layer of anisotropic pyrolytic boron nitride;

a heater element of anisotropic pyrolytic graphite formed as integral coating on said subtrate.

4. A thermionic cathode structure comprising:

a cathode body with an extended electron emissive surface, an insulating layer of anisotropic boron nitride having a layer of anisotropic pyrolytic graphite disposed thereon, said insulating layer being bonded to a surface of said cathode body removed from said emissive surface by said anisotropic pyrolytic graphite layer, a heater layer of anisotropic pyrolytic graphite bonded to the surface of said insulating layer opposite the surface bonded to said cathode body. and a plurality of electrical contacts to said heater layer for passing heating current therethrough.

5. The cathode structure of claim 3 further comprising a second layer of anisotropic boron nitride bonded to the surface of said heater layer opposite said insulating layer.

6. The cathode of claim 3 further comprising insulating gaps in said heater layer to restric said heater current into at least one extended band, narrower than to the overall extent of said emissive surface.

7. The cathode of claim 3 wherein said bonding to said cathode body is by sintering.

8. The cathode of claim 7 further comprising a sintering layer between said cathode body and said insulating layer.

9.The cathode of claim 8 wherein said sintering layer is a mixture of tungsten sand nickel.

* * * * *